US005503394A

United States Patent [19]

Mauck et al.

[11] Patent Number: 5,503,394

[45] Date of Patent: Apr. 2, 1996

[54] GOLFING ACCESSORY

[76] Inventors: David W. Mauck, P.O. Box 1612, Dublin, Va. 24084; Bobby L. Shelton, 602 Denby St., Radford, Va. 24141

[21] Appl. No.: 310,400

[22] Filed: Sep. 22, 1994

[51] Int. Cl.[6] ..... A63B 57/00

[52] U.S. Cl. ..... 273/32.5

[58] Field of Search ..... 273/32.5, 32 R, 273/32 A, 32 B, 32 E; 294/19.1, 19.2

[56] References Cited

U.S. PATENT DOCUMENTS

| | | | |
|---|---|---|---|
| 2,609,198 | 9/1952 | Armstrong | 273/32.5 |
| 4,616,826 | 10/1986 | Trefts | 273/32.5 |
| 4,714,250 | 12/1987 | Henthorn | 273/32.5 |
| 4,819,938 | 4/1989 | Hill | 273/32.5 |
| 4,951,947 | 8/1990 | Kopfle | 273/32.5 |
| 4,969,646 | 11/1990 | Tobias | 273/32.5 |
| 5,080,357 | 1/1992 | Wolf | 273/32.5 |
| 5,127,530 | 7/1992 | Ortuno | 273/32 E X |
| 5,310,177 | 5/1994 | Conrad et al. | 273/32.5 |
| 5,330,177 | 7/1994 | Rogge | 273/32.5 |
| 5,330,178 | 7/1994 | Geishert, Sr. | 273/32.5 |
| 5,439,213 | 8/1995 | Pimental | 273/32.5 |

*Primary Examiner*—William H. Grieb

[57] ABSTRACT

A device which permits golfers to tee up a golf ball without needing to bend down to the ground to do so and which, in addition, provides a portable golf club stand. It utilizes an elongated spring-loaded tube disposed within an outer tube and having a golf ball holder and a gripper for a golf tee on one end thereof. Levers are arranged to permit release of the tee and ball when the unit has been inverted to set the tee in the ground. Adjustable spacers are provided to set the tee at the desired ground elevation. Grooves in the handle and a ground penetrating rod cooperate to have the unit function as a holder for up to four clubs.

1 Claim, 5 Drawing Sheets

GOLFING ACCESSORY

BACKGROUND OF THE INVENTION

1. Field of the Invention

The present invention relates to a golfing accessory and more particularly pertains to a device which assists in teeing up a golf ball and in removing a tee from the ground when desired as well as serving as a portable golf club stand.

2. Description of the Prior Art

The use of tee-up accessories is well-known in the prior art. More specifically, devices heretofore devised and utilized for the purpose of assisting in the teeing-up of golf balls are known to consist basically of familiar, expected and obvious structural configurations, notwithstanding the myriad of designs encompassed by the crowded prior art which have been developed for the fulfillment of countless objectives and requirements. Faced with a common problem, these devices and that of the present invention are necessarily quite similar. Spacing of the tee above ground generally has not been adjustable with any degree of repeatability and such units have generally not had stand-alone capabilities permitting use as a club holder.

In this respect, the accessory device according to the present invention substantially departs from the conventional concepts and designs of the prior art, and in so doing provides an apparatus primarily developed for the purpose of providing for duplicatable results in tee positioning and also of providing a portable golf club stand. Similar devices located in the prior art include those shown in U.S. Pat. Nos. 4,714,250; 4,616,826; 4,819,938; 5,080,357; and 4,969,646.

Therefore, it can be appreciated that there exists a continuing need for new and improved teeing up devices which can be utilized without the need for the golfer to bend over and yet which will give reproducible results as to tee height. In this regard, the present invention substantially fulfills this need.

SUMMARY OF THE INVENTION

In view of the foregoing disadvantages inherent in the known types of golfing accessories now present in the prior art, the present invention provides an improved teeing up construction wherein the same can be utilized to set tees at a desired height, to function to remove tees from the ground, and which in addition will serve as a stand for clubs on the course. As such, the general purpose of the present invention, which will be described subsequently in greater detail, is to provide a new and improved golfing accessory which has all the advantages of the prior art devices and none of the disadvantages.

To attain this, the present invention essentially comprises a device which permits golfers to tee up a golf ball without needing to bend down to the ground to do so and which, in addition, provides a portable golf club stand. It utilizes an elongated spring-loaded tube disposed within an outer tube and having a golf ball holder and a gripper for a golf tee on one end thereof. Levers are arranged to permit release of the tee and ball when the unit has been inverted to set the tee in the ground. Adjustable spacers are provided to set the tee at the desired ground elevation. Grooves in the handle and a ground penetrating rod cooperate to have the unit function as a holder for up to four clubs. The tee gripper may likewise be used for removal of tees from the ground.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golfing accessory which has all the advantages of the prior art devices and none of the disadvantages.

It is another object of the present invention to provide a new and improved golfing accessory which may be easily and efficiently manufactured and marketed.

It is a further object of the present invention to provide a new and improved golfing accessory which is of a durable and reliable construction.

An even further object of the present invention is to provide a new and improved golfing accessory which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved golfing accessory which provides in the apparatuses and methods of the prior art some of the advantages thereof, while simultaneously overcoming some of the disadvantages normally associated therewith.

Still another object of the present invention is to provide a new and improved golfing accessory which permits remotely setting a tee to a predetermined height above ground level.

Yet another object of the present invention is to provide a new and improved golfing accessory which provides a portable on-course holder for up to four golf clubs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
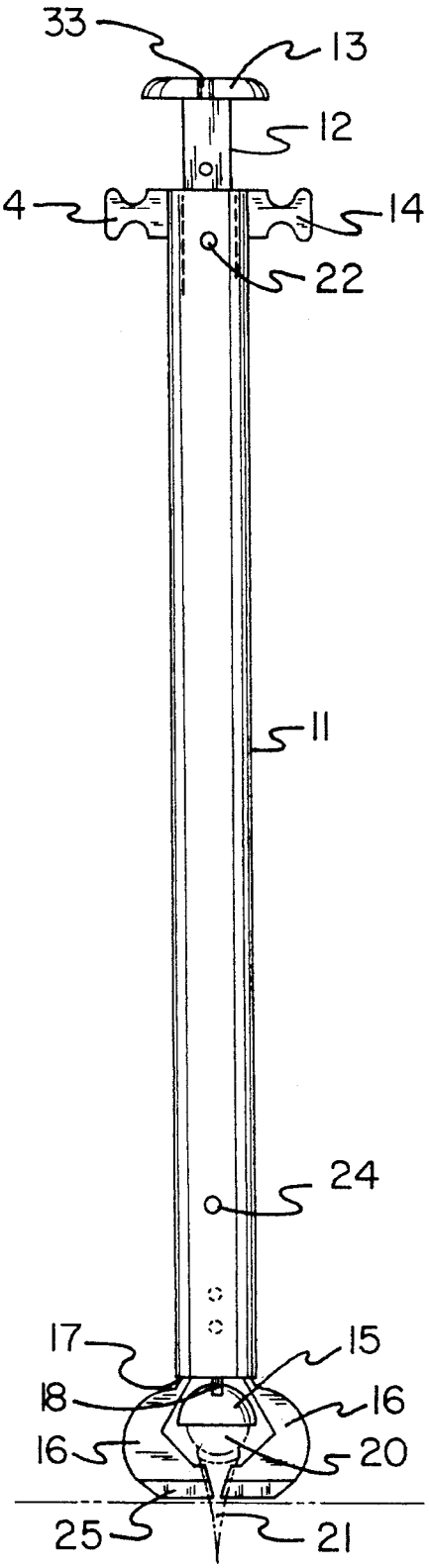
FIG. 1 is a front plan view of the device of the present invention in the locked or ball-holding position.
Figure 2:
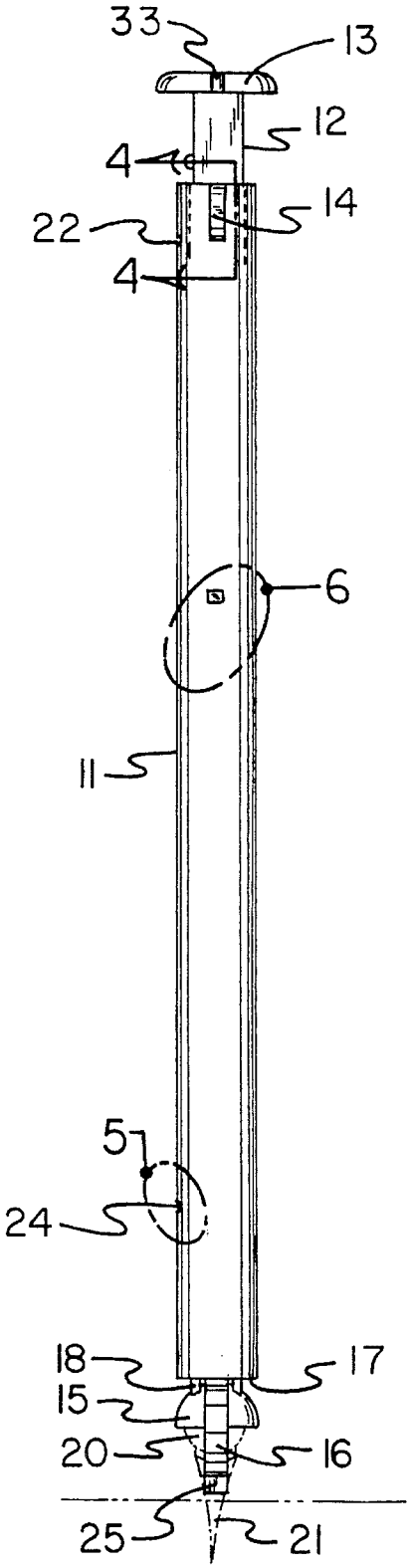
FIG. 2 is a side plan view of the device of FIG. 1.
Figure 3:
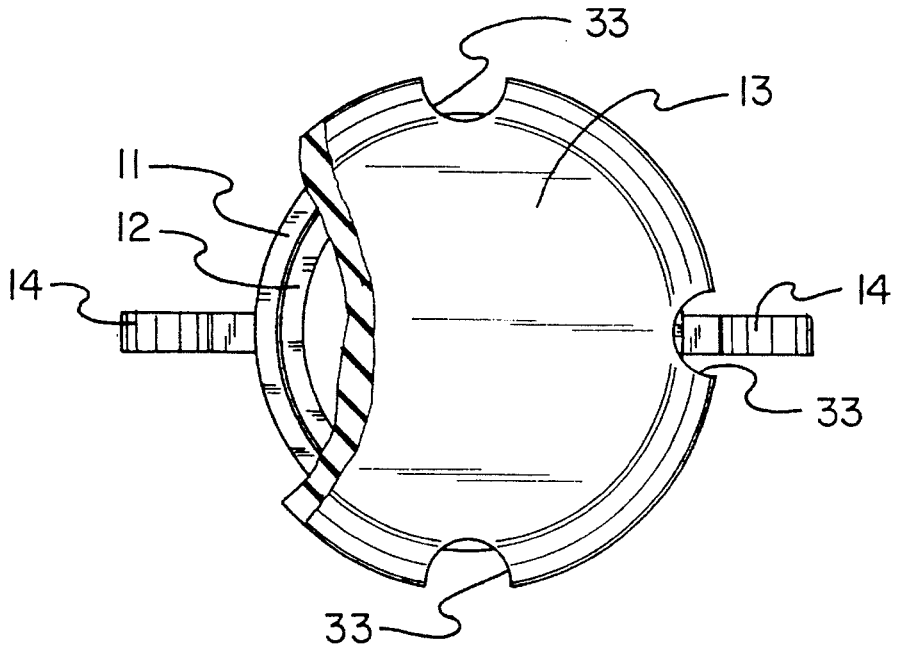
FIG. 3 is a top view (partially cut away) of the device of FIG. 1.

With reference now to the drawings, and in particular to FIGS. 1 through 3 thereof, a new and improved golfing accessory embodying the principles and concepts of the present invention and generally designated by the reference numeral 10 will be described.

Figure 7:
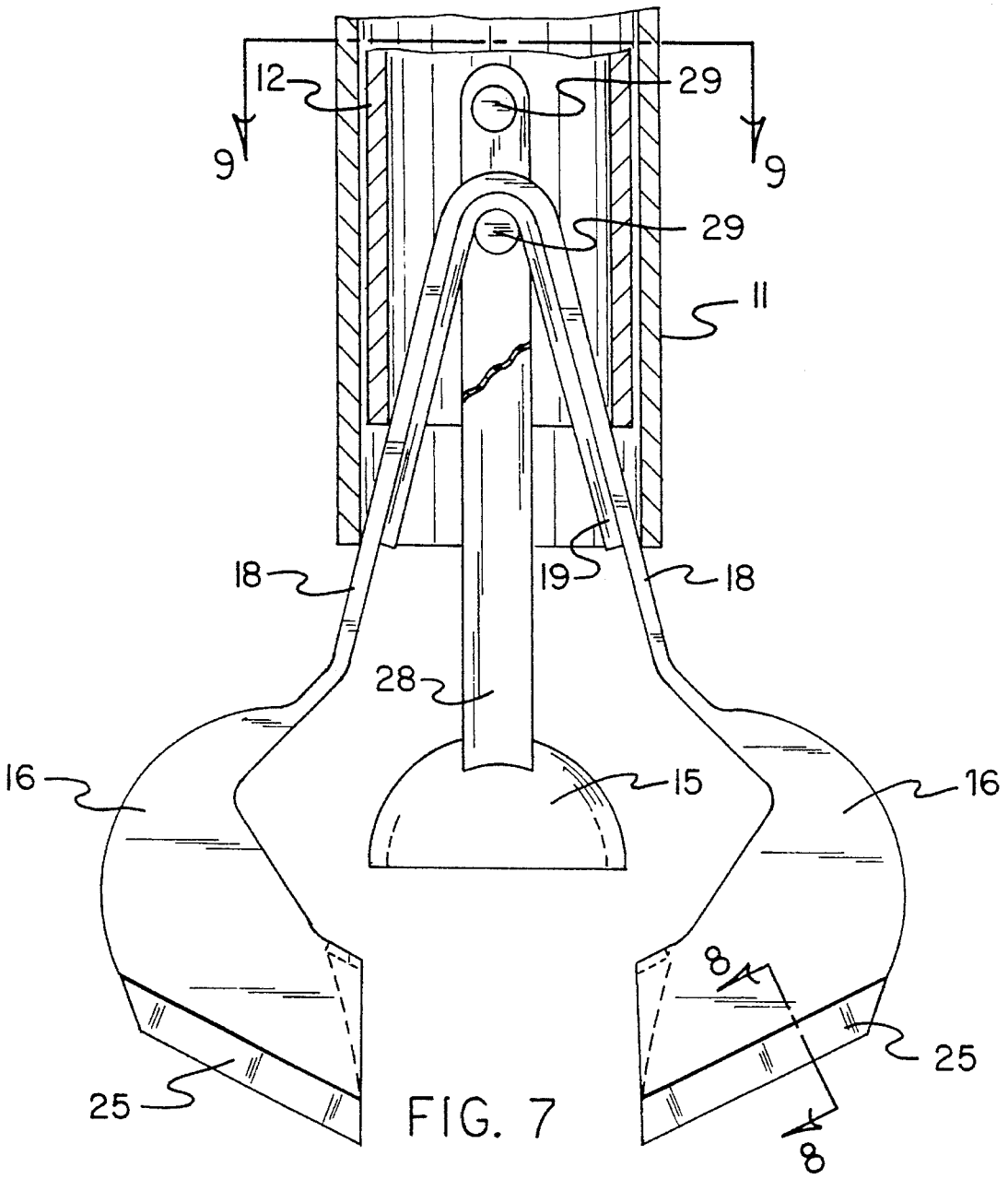
FIG. 7 is a sectional view of the ball holder and tee clamp of the device of the invention.

More specifically, it will be noted that the device 10 comprises an elongated slender tubular rod member 11 having a second somewhat smaller diameter tubular member 12 slideably positioned therein. Member 12 has at its upper end a flat padded handle 13 having a plurality of spaced club receiving notches in the periphery thereof designed to be engaged with the palm of a user, while member 11 has at its upper end a pair of opposed, laterally extending finger grip members 14. The lower end of member 12 terminates in a fixed, downwardly-opening hemispherical cup member 15 and a pair of pivotally mounted clamp or grasping members 16. When tubular member 11 is in its lowermost position relative to member 12, the end 17 of member 11 engages with and forces together arms 18 of clamp members 16. FIG. 7 below illustrates this in detail and will supplement the description of the operation of device 10 herein.

Before describing the rest of the drawings, a brief description of how device 10 works will help in understanding the same. Initially, a user will place the palm of his hand on handle 13 and while gently pressing down thereon will engage finger grip members 14 with two fingers and pull upwardly thereon. This causes the end 17 of member 11 to slip up on arms 18 of clamp member 16 allowing said arms 18 to move apart under the urging of a leaf spring 19 (shown in FIG. 7 below). While in this configuration, the user inverts device 10 in order to place cup member 15 in a readily accessible position. A golf ball 20 shown in broken lines in FIG. 1 is then dropped into the open cup 15 and a golf tee 21 also shown in broken lines in FIG. 1 is placed on such ball and held in place thereon with the fingers while using the hands to squeeze the outer tubing. This will cause a friction lock detent 22 to disengage allowing the inner tube to be forced upwardly by the action of an internal spring 23 (shown in FIG. 6) until a second friction lock detent 24 snaps into place and the end 17 of member 12 again engages with the lower portion of arms 18 and forces them against the leaf spring 19 to lock around the ball 20 and tee 21 holding them in fixed engagement with clamp members 16. Device 10 is then brought back to its normal non-inverted position and placed with its lower end 17 towards the ground. Gentle pressure will then cause the pointed end of tee 21 to penetrate the ground. The degree of penetration is held to a controlled extent being dictated by the ball height shims 25 selected by the user and previously snapped to the bottom edge of clamp members 16. Once in place, a repetition of the freeing of the clamp members 16 is carried out and device 10 is removed to leave the ball 20 positioned on the tee 21 at the desired elevation as set by shims 25.

Figure 4:
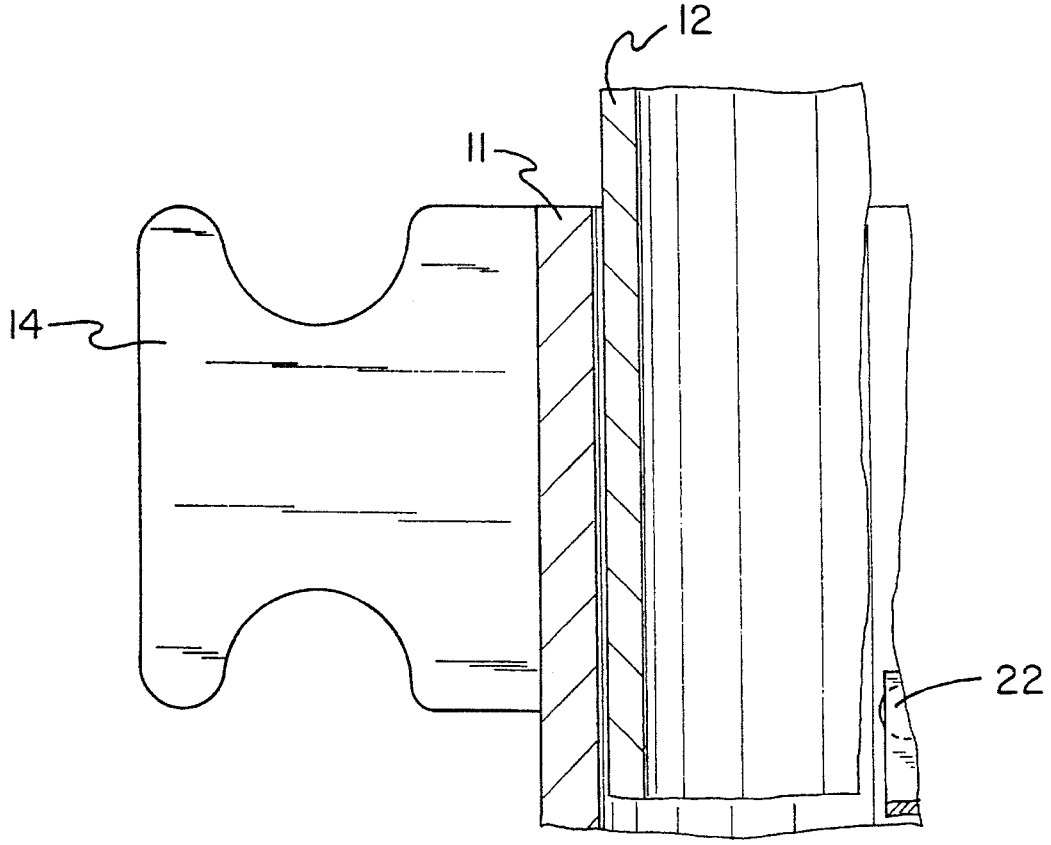
FIG. 4 is a sectional view on line 4—4 of FIG. 2.
Figure 5:
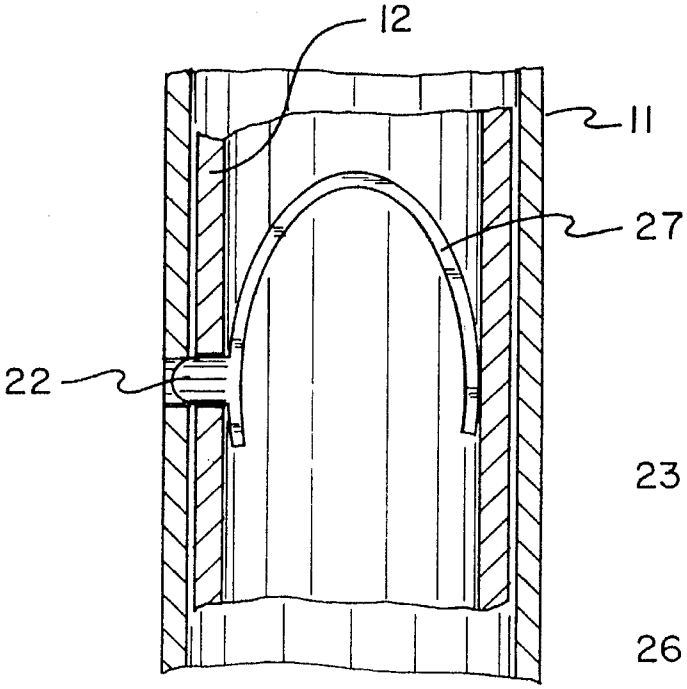
FIG. 5 is a sectional view of the area designated as circle 5 on FIG. 2.

FIG. 4 illustrates the finger grip 14, the slideable arrangement of tubular members 11 and 12, and the friction detent 22, which is shown in greater detail in FIG. 5. It will be noted that detent 22 is fastened to a simple leaf spring 27 within member 12 which permits it to snap into and out of locked position as members 11 and 12 are moved relative to one another.

Figure 6:
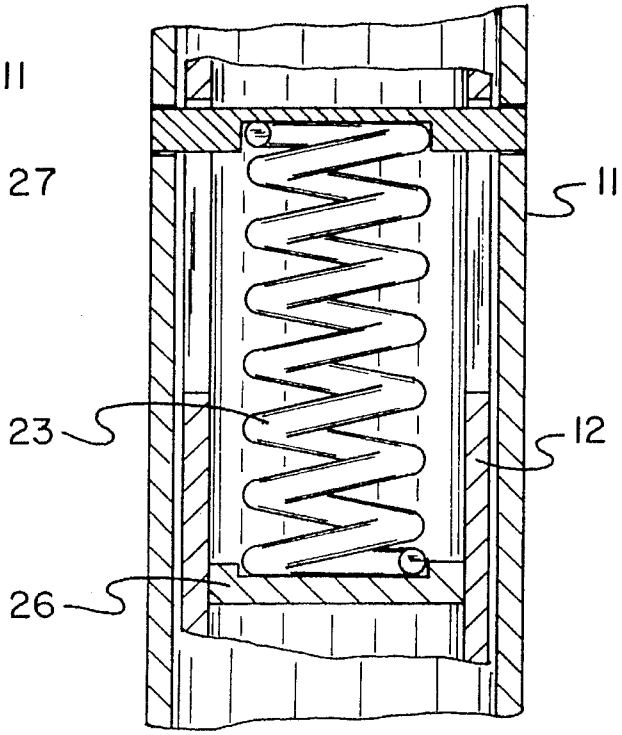
FIG. 6 is a sectional view of the area designated as circle 6 on FIG. 2.

FIG. 6 shows the internal spring 23 mentioned above which will cause member 12 to move into the unlock position when member 11 is squeezed to release detent 22. A compression plate 26 is affixed internally of member 12 to work against spring 23.

Figure 8:
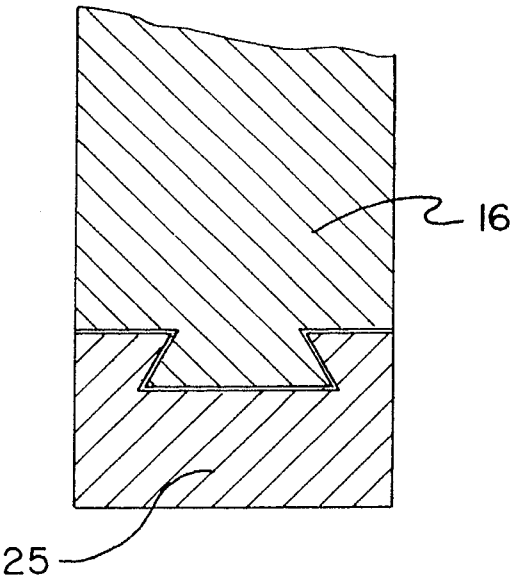
FIG. 8 is a sectional view on line 8—8 of FIG. 7.

FIG. 7 shows in an enlarged drawing the components of the clamp end of member 12. This Figure illustrates that arms 18 connect to the arcuate scoop members forming clamp members 16 and overlie a leaf spring 19 held in position inside member 12 by a pair of alignment pins 29 which also holds the arm 28 supporting cup member 15. It will be noted that arms 18 connect to each other forming a continuous connection between the scoops of clamps 16. Of particular interest in this view are the ball height shims 25 which clip onto clamps 16 (also shown in detail in FIG. 8). At least two pairs of different height shims are supplied with each device 10.

Figure 9:
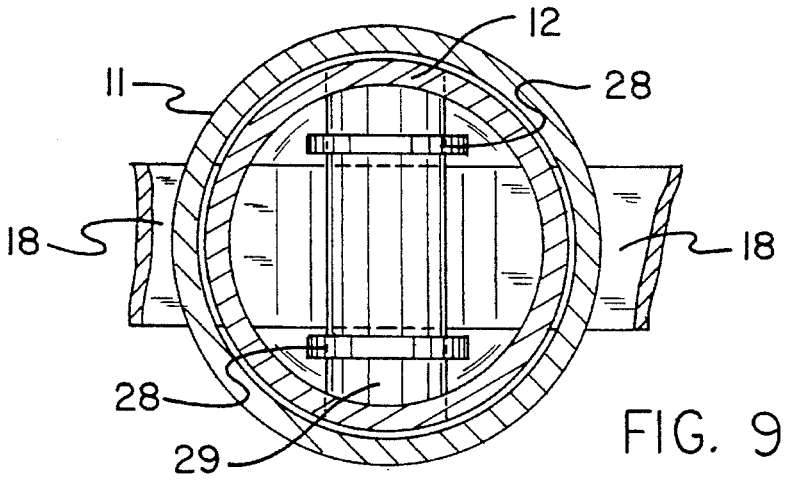
FIG. 9 is a sectional view on line 9—9 of FIG. 7.

FIG. 9 is a sectional view looking down on the assemblage shown in FIG. 7, illustrating pin 29, arm 28 and arms 18.

Figure 10:
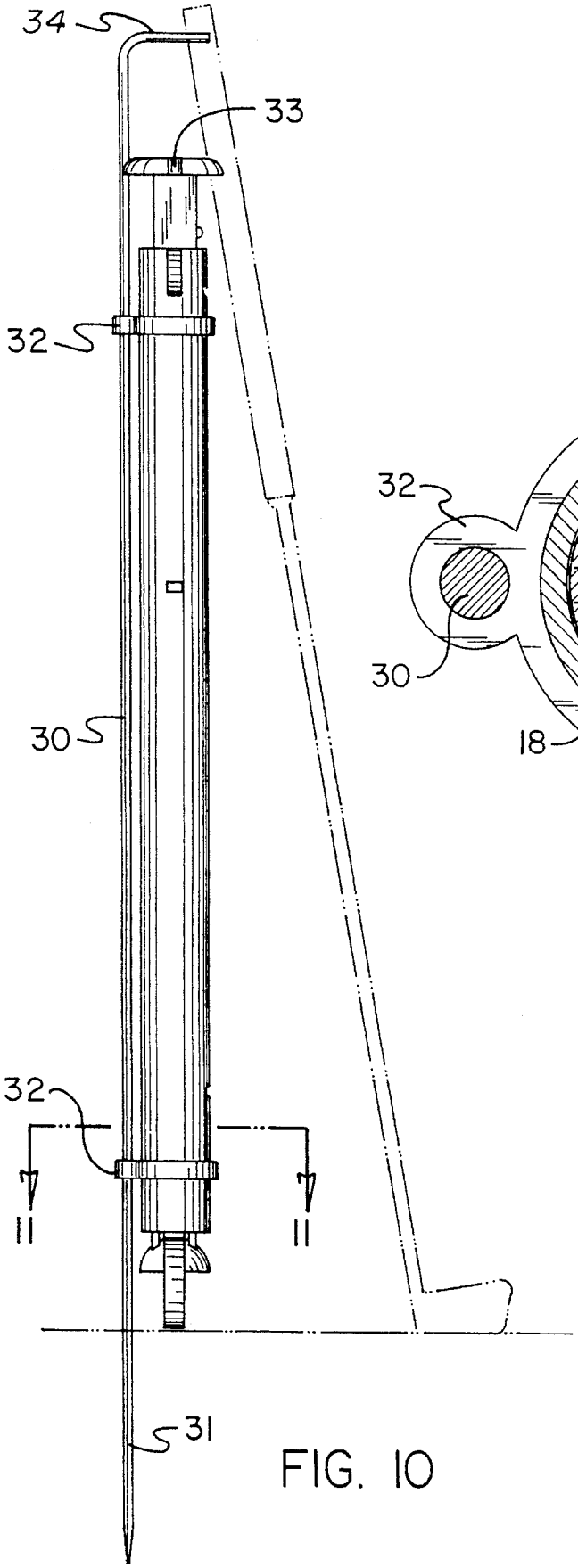
FIG. 10 is a side plan view of the device of FIG. 1 showing the means for converting the device 10 into an on-course golf club stand.
Figure 11:
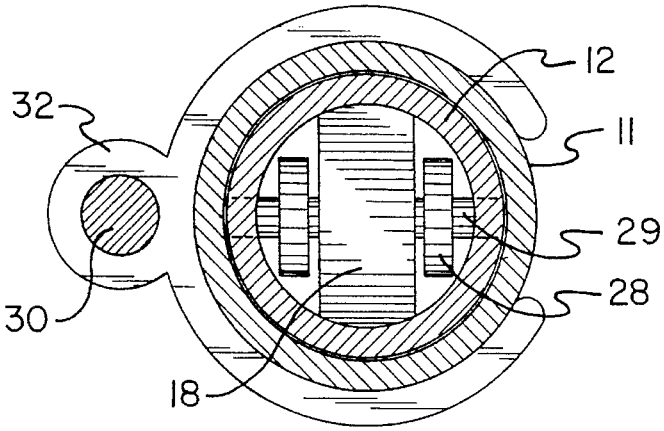
FIG. 11 is a sectional view on line 11—11 of FIG. 10.

FIGS. 10 and 11 show an important feature of device 10 which was ommitted from earlier views for purposes of clarity. This is the ground anchoring member 30 which permits the device 10 to be utilized as a golf club stand. A rod 30 having a sharpened lower end 31 is designed to be inserted at depth into the ground to form a sturdy support for device 10 to which it is slideably affixed with a pair of spring clamps 32, making device 10 free-standing The upper end of rod 30 has an L-shaped bend 34 to facilitate removing rod 30 from the ground. Handle 13 has a plurality of club-engaging grooves 33 therein permitting up to four clubs to be held as shown by the broken line drawing of a club in FIG. 10. Rod 30 is normally in the up or non-ground contacting position when the device 10 is used for positioning a ball or tee or for removing a pre-set tee.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved golfing accessory device which comprises:

an elongated tubular member having a pair of elongated slender hollow tubes, one slidably positioned within the other, a handle secured to an upper end of an innermost of said tubes, a pair of laterally extending opposed fingers grips affixed to an upper end of an outermost of said tubes, the outermost tube having apertures formed at upper and lower ends thereof, the innermost tube having friction lock detents at upper and lower end thereof for selective engagement with said apertures of said outermost tube;

a tee clamping and golf ball holding means being affixed to a lower end of said innermost tube and engageable with a lower end of said outermost tube to effect closure thereof, the tee clamping and golf ball holding means comprising a pair of opposed arcuate scoops, flexible arms attached to each of said scoops and forming a continuous connection therebetween, said arms extending up into said elongated tubular means and being held therein by passage over a retaining pin, a leaf spring positioned under and in contact with said arms to force said arms apart, a hemispherical hollow golf ball holder affixed by retaining pins to said innermost tube and extending downwardly between said clamp scoops, said arms being compressible inwardly when said outermost tube is moved downwardly relative to said innermost tube, a pair of shims of predetermined width removably fastened to the lower ends of said clamping means, the tee clamping and golf ball holding means having means to engage and disengage with a golf ball comprising an internal spring loading of said elongated tubular means whereby said tubular means may engage with and release from said clamping and holding means by sliding up and down with respect thereto; and a ground penetrating means to permit said elongated tubular means to free-stand and support a plurality of golf clubs leaned thereagainst, the ground penetrating means comprises an elongated, small diameter rod having a sharp point at one end thereof and an L-shaped handle at the other end thereof, and a pair of retaining clamps slidably affixing said rod to said elongated tubular member, said L-shaped handle having a bent portion terminating in a pair of curved arms positioned perpendicularly from the elongated tubular means, the pair of curved arms being adapted to receive a plurality of golf clubs leaned thereagainst.

* * * * *